US006471554B2

(12) United States Patent
Armistead et al.

(10) Patent No.: US 6,471,554 B2
(45) Date of Patent: Oct. 29, 2002

(54) MULTI-WAY ELECTRICAL CONNECTION DEVICE HAVING A COMPLIANT CONNECTOR

(75) Inventors: Trevor Armistead, Cumbria (GB); Robert Graham Armistead, Cumbria (GB)

(73) Assignee: Oxley Developments Company Limited, Cumbria (GB)

( * ) Notice: Subject to any disclaimer, the term of this patent is extended or adjusted under 35 U.S.C. 154(b) by 0 days.

(21) Appl. No.: 09/844,307

(22) Filed: Apr. 27, 2001

(65) Prior Publication Data

US 2001/0039152 A1 Nov. 8, 2001

(30) Foreign Application Priority Data

Apr. 27, 2000 (GB) ..... 00110282

(51) Int. Cl.[7] ..... H01R 13/33
(52) U.S. Cl. ..... 439/841; 439/788
(58) Field of Search ..... 439/841, 840, 439/788

(56) References Cited

U.S. PATENT DOCUMENTS 1,884,582 A * 10/1932 Crawford ..... 439/841
2,521,722 A * 9/1950 Hubbell et al. ..... 439/788
2,890,266 A * 6/1959 Bollmeier ..... 439/841
3,157,455 A * 11/1964 Takano ..... 439/841
3,503,033 A * 3/1970 Kennedy, Jr. ..... 439/841
3,885,848 A * 5/1975 Brouneus ..... 439/841
4,632,496 A * 12/1986 Williams ..... 439/841
4,851,765 A * 7/1989 Driller et al. ..... 439/841
5,906,520 A * 5/1999 Frinker et al. ..... 439/841
6,247,943 B1 * 6/2001 Moga et al. ..... 439/125

FOREIGN PATENT DOCUMENTS

GB 2 205 201 11/1988
GB 2 214 513 9/1989

* cited by examiner

*Primary Examiner*—Tulsidas Patel
*Assistant Examiner*—Hae Moon Hyeon
(74) *Attorney, Agent, or Firm*—Christie, Parker & Hale, LLP

(57) ABSTRACT

An electrical connector comprising an at least substantially helical winding shaped to provide a first portion, having a diameter suitable to receive and embrace an electrical contact when inserted therein, and a second portion of larger diameter than the first for contacting an electrical terminal when disposed around or adjacent the contact, to thereby form an electrical connection from the contact to the terminal.

7 Claims, 2 Drawing Sheets

MULTI-WAY ELECTRICAL CONNECTION DEVICE HAVING A COMPLIANT CONNECTOR

CROSS REFERENCE TO RELATED APPLICATION

Figure 1:
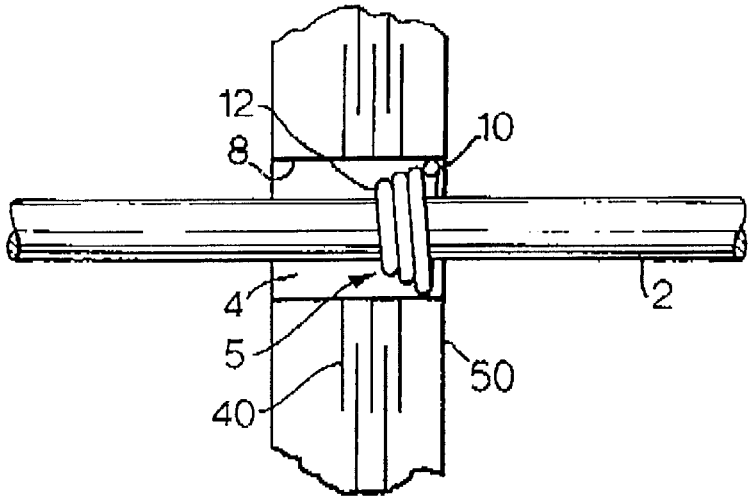

This application claims priority of United Kingdom patent Application No. 0010282.2, filed on Apr. 27, 2000.

The present invention is concerned with electrical connectors, and particularly (but not exclusively) with compliant electrical connectors for use in planar array filters.

A particularly important application of the present invention relates to filtration of electromagnetic interference (EMI). It is increasingly important to filter EMI from electronic signal interconnections because this spurious interference can otherwise cause serious malfunction of electronic systems.

Conventionally this is achieved in a volumetrically efficient way by incorporating a ceramic planar array inside a multi-way connector. A typical example of this is shown in UK Patent No. 2205201.

Ceramic planar arrays are multi-layer structures whereby metal electrodes 40 are interleaved with ceramic dielectric layers in a monolithic block 50 with lead through holes 4 corresponding to the multi-way contacts of the connector. The electrodes serve as capacitor plates and are designed so that each lead through has a separate capacitance to earth. That is, each lead through is connected to one side of a capacitor the other side of which is connected to the connector outer metal shell which contacts each through a chassis.

The lead through holes in the planar array are metallised, the metallisation being connected to selected electrodes (ie. to one side of the multi-layer capacitor which is to be electrically connected to the lead through contact). The signal is carried by lead through contacts in the form of elongate pins. Clearly there is a requirement for a connection to be formed between the metallisation and the lead through contact itself. This has traditionally been achieved by using a solder connection (eg. as described in GB2214513A) or a spring clip.

An object of the present invention is to provide for the required connection in a robust, reliable and constructionally straightforward manner.

In accordance with a first aspect of the present invention there is an electrical connector comprising an at least substantially helical winding shaped to provide a first portion, having a diameter suitable to receive and embrace an electrical contact inserted therein, and a second portion of larger diameter than the first for contacting an electrical terminal disposed around or adjacent the contact, to thereby form an electrical connection from the contact to the terminal.

The winding may be formed of metal, whose compliance assists in assuring reliable electrical contact.

Benefits which accrue from this simple arrangement include much reduced assembly costs and stress free, compliant, reliable electrical contact, there being no soldering heat nor direct rigid mechanical connection.

The stress produced by temperature changes is also much reduced by having a compliant contact so that expansion/contraction of the metal parts of the connector do not bear upon the brittle ceramic of a planar array.

A planar array utilising connectors according to the present invention can in addition be designed to be repairable, noting that the earth connection to the array is usually sprung from the outer connection of the planar array to the inside of the connector shell.

By making the internal diameter of the first portion smaller than the external diameter of the contact to be inserted therein it can be ensured that pressure and electrical contact between the two is maintained.

The external diameter of the second portion may be selected to be larger than the internal diameter of an electrical terminal formed as a bore into which the second portion is insertable, so that the second portion is radially, compliantly compressed within the bore to maintain pressure and electrical contact between the bore's inner surface and the second portion.

The connector may be formed to function as a compression spring when retained between two opposed, axially facing surfaces in order that the connector may form an electrical connection to at least one of the surfaces.

In certain arrangements the connector may be both radially and axially compliantly deformed.

According to a second aspect of the present invention there is an electrical connection arrangement comprising a connector constructed according to the first aspect of the present invention.

According to a third aspect of the present invention there is an electronic filter comprising a block containing electrodes forming at least one capacitor, at least one lead through hole in the block receiving a lead through contact, and a connector according to the first aspect of the present invention forming an electrical connection from the lead through contact, which is received in the connector, to metallisation of the lead through hole and so to one or more of the electrodes.

Figure 2:
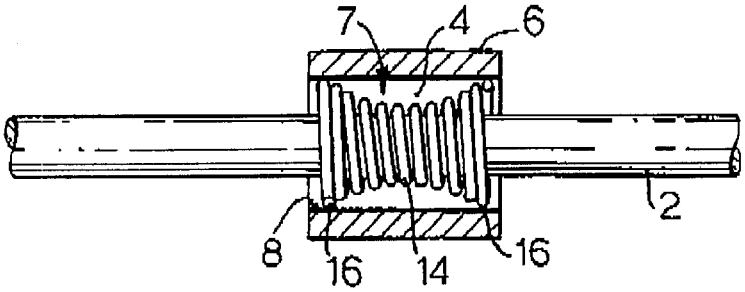
Figure 3:
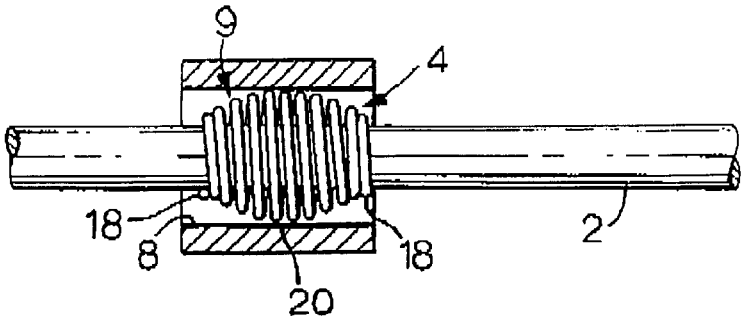
Figure 4:
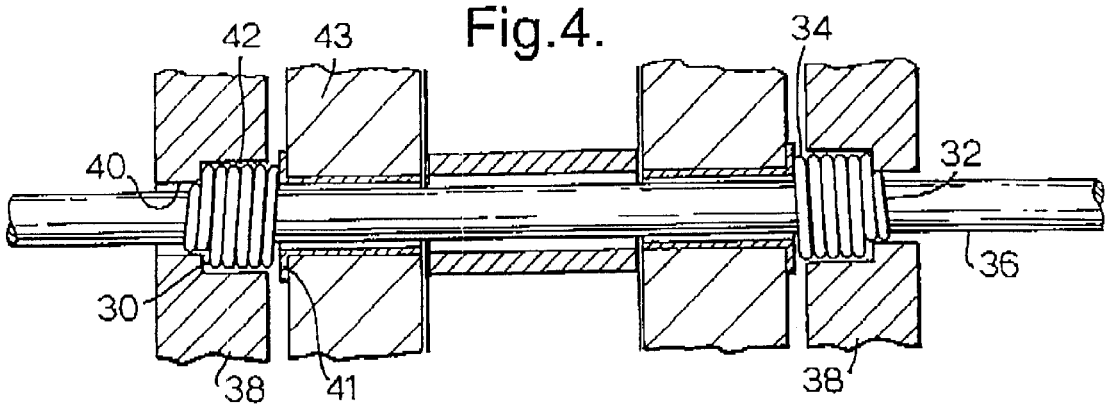
Figure 5:
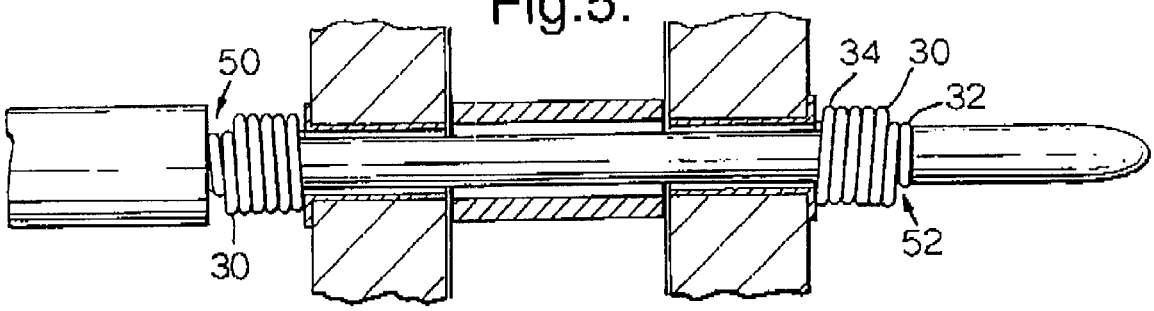
Figure 6:
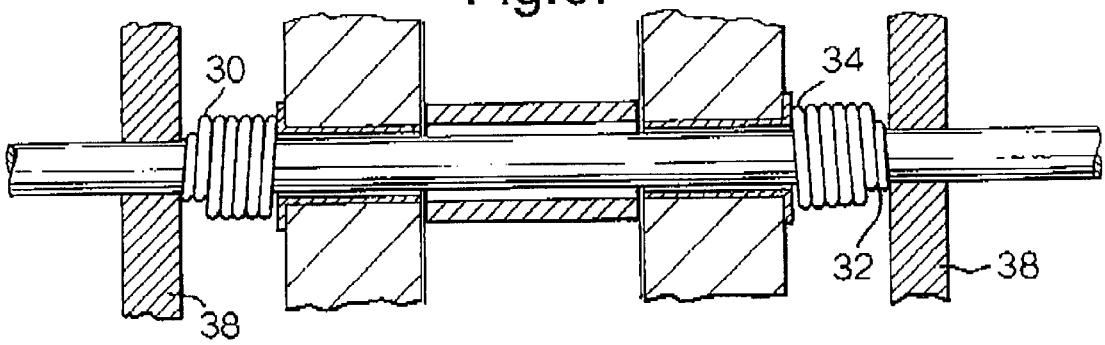

Specific embodiments of the present invention will now be described, by way of example only, with reference to the accompanying drawings in which: FIGS. 1, 2 and 3 respectively illustrate, in side view and partly in section, connector arrangements comprising first, second and third connectors embodying the present invention; FIGS. 4, 5 and 6 respectively illustrate, again in side view and partly in section, connector arrangements comprising a fourth type of connector embodying the present invention.

Figure 7:
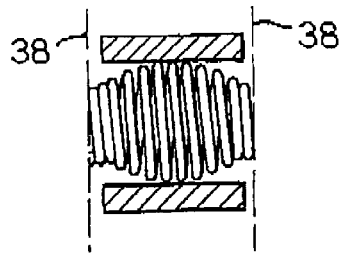

FIG. 7 is a schematic view of an alternative embodiment of the invention.

Each of the illustrated connectors embodying the present invention is formed as a helical coil of metal wire.

In each of FIGS. 1 to 3 is seen an electrical lead through connection in the form of a pin 2. This is received in a lead through hole 4. In the drawings the lead through hole 4 is formed in a tube 6 but in practice the hole may for example be formed in a planar capacitor array of the type described above. In each of FIGS. 1 to 3 the pin 2 must be connected to an electrical terminal formed by a layer 8 of metallisation formed on the interior of the lead through hole 4. The required connection is formed in each case by a respective connector embodying the present invention.

The connector 5 illustrated in FIG. 1 has a frusto-conical shape formed by several turns of the wire helix, thus providing a larger diameter portion 10 and a smaller diameter portion 12. The diameter of the larger diameter portion 10 is chosen such as to form a reliable contact to the metal layer 8. This diameter is slightly larger than the internal diameter of the metal layer so that upon insertion the portion 10 is slightly deformed ensuring, due to the compliance of the wire from which the connector is formed, that pressure between the metal layer 8 and the larger diameter portion 10 is maintained. The smaller diameter portion 12 is such as to embrace and form a reliable contact to the pin 2, the internal diameter of this portion (prior to insertion of the pin 2) being slightly smaller than the pin's external diameter.

The connector 7 illustrated in FIG. 2 has a waisted shape, a smaller diameter portion 14 for embracing the pin 2 being formed between two larger diameter portions 16 which both contact the metal layer 8.

The connector 9 illustrated in FIG. 3 has a bellied shape, two smaller diameter portions 18 being formed at the connector ends and between them being a larger diameter portion 20.

In each case the diameters chosen and the compliance of the connector 5, 7, 9 ensure that electrical contact between the pin 2 and the metal layer 8 is reliably achieved.

Whereas in each of FIGS. 1 to 3 the connector is radially compressed within its lead through hole 4 to provide the required electrical connection, the embodiments illustrated in FIGS. 4 to 6 each utilise a connector which is axially compressed and which contacts an axially facing terminal surface.

In each case a pair of connectors 30 is provided, both having a smaller diameter end portion 32 followed by a larger diameter portion 34 which serves as a compression spring.

Looking specifically at FIG. 4, a lead through connection is again formed as a pin, labelled 36 in this drawing and passing through a pair of end walls 38, each having a bore 40 receiving the pin 36 and a larger counterbore 42 receiving both the pin and the larger diameter portion 34 of a respective connector 30. The connector 30 is in both cases axially compressed between a shoulder formed at the end of the counterbore and an electrical terminal 41.

The terminal 41 is formed as a metallised ring on a plate 43 facing the end wall 38 and is integral with metallisation within a bore in the plate 43. The contact surface of the terminal 41 aces along the axis of the arrangement and because of the axial compression of the connector, an end of the connector is maintained reliably in contact with this surface. At the connector's other end its smaller diameter portion embraces and so contacts the pin 36.

Other arrangements utilising the same connector 30 are illustrated in FIGS. 5 and 6.

In FIG. 5 axial compression of the connector is achieved by having its smaller diameter portion 32 abut an axially facing shoulder of the pin 36 itself at locations 50 and 52.

FIG. 6 illustrates an arrangement somewhat less axially compact than that of FIG. 4, the connectors 30 not being received in counterbore in the end walls 38.

It should be understood that the connectors 5, 7 and 9 may themselves be used in arrangements in which they are axially compressed, thus exerting both radial and axial forces on the surfaces with which they are in contact, for example as shown schematically in FIG. 7.

We claim:

1. A multi-way electrical connection device comprising:

a block containing electrodes forming at least one filter capacitor;

a plurality of lead through holes formed through the block, an interior of at least one of the lead through holes having a metal layer that is in electrical contact with at least one electrode, the metal layer having an internal diameter;

a plurality of elongate pins, each pin passing through one of the plurality of lead through holes in the block; and a connector that electrically connects the at least one electrode that is in electrical contact with the metal layer to the pin, the connector being disposed around the pin and within the metal layer, the connector having an at least substantially helical winding shape to provide a first portion having a diameter suitable to receive and embrace one of the pins when one of the pins is inserted therein to form and electrical connection therewith, and a second portion of larger diameter than the first, the second portion having an external diameter larger than the internal diameter of the metal layer, such that the external diameter of the second portion is radially compressed within the metal layer to maintain pressure and electrical contact therewith.

2. An electrical connection device according to claim 1, wherein the winding is formed of metal, whose compliance assists, in use of the connector, in assuring reliable electrical contact.

3. An electrical connection device according to claim 1, wherein the diameter of the turns of said winding of the electrical connector increases progressively along its length from said smaller diameter first portion to said larger diameter second portion.

4. An electrical connection device according to claim 1, wherein there are two of said second portion of larger diameter than the first portion, said two second portions being disposed on the two sides respectively of the first portion whereby the connector has a "waisted" shape.

5. An electrical connection device according to claim 1, wherein there are two of said first portions disposed on the two sides of the second portion respectively, whereby the connector has a "bellied" shape.

6. An electrical connection device according to claim 1, wherein the connector is axially compressed.

7. An electrical connection device according to claim 1, further comprising two opposed, axially facing surfaces between which the connector is axially compressed.

* * * * *

UNITED STATES PATENT AND TRADEMARK OFFICE

CERTIFICATE OF CORRECTION

PATENT NO. : 6,471,554 B2
DATED : October 29, 2002
INVENTOR(S) : Trevar Armistead et al.

It is certified that error appears in the above-identified patent and that said Letters Patent is hereby corrected as shown below:

Title page,
Item [30], Foreign Application Priority Data, replace "00110282" with -- 0010282.2 --.
Item [57], ABSTRACT,
Line 8, add -- [FIG.1] -- after "terminal."

Signed and Sealed this

Twenty-seventh Day of January, 2004

JON W. DUDAS
*Acting Director of the United States Patent and Trademark Office*